US007958580B2

(12) United States Patent
Zorger

(10) Patent No.: US 7,958,580 B2
(45) Date of Patent: Jun. 14, 2011

(54) METHOD AND APPARATUS FOR INSERTING A PILLOW INTO A PILLOWCASE

(76) Inventor: Nancy A. Zorger, North Manchester, IN (US)

( * ) Notice: Subject to any disclaimer, the term of this patent is extended or adjusted under 35 U.S.C. 154(b) by 350 days.

(21) Appl. No.: 12/274,632

(22) Filed: Nov. 20, 2008

(65) Prior Publication Data

US 2009/0144901 A1 Jun. 11, 2009

Related U.S. Application Data

(60) Provisional application No. 60/992,813, filed on Dec. 6, 2007.

(51) Int. Cl.
*A47G 9/10* (2006.01)

(52) U.S. Cl. ..... 5/489; 5/490; 141/390; 53/255

(58) Field of Classification Search ..... 5/488–490; 53/390, 527, 528, 436, 438, 439, 255, 256, 53/261, 262; 141/390, 391, 316; 248/95, 248/99

See application file for complete search history.

(56) References Cited

U.S. PATENT DOCUMENTS 1,712,711 A 5/1929 Morgan et al.
1,879,410 A * 9/1932 Morris et al. ..... 493/480
3,915,329 A 10/1975 Zaks
3,983,914 A * 10/1976 Benson ..... 141/390
4,749,011 A * 6/1988 Rylander ..... 141/316
4,760,037 A 7/1988 Ohdate
4,761,872 A * 8/1988 Buettner et al. ..... 29/451
5,239,741 A 8/1993 Shamos
5,673,446 A 10/1997 Moen et al.
5,716,033 A 2/1998 Gibson
5,897,084 A * 4/1999 Judge ..... 248/95
6,065,512 A 5/2000 Munn, II
6,340,037 B1 * 1/2002 Stafford ..... 141/316
6,839,923 B2 1/2005 Blessman
7,007,324 B2 3/2006 Blessman
2006/0185086 A1 8/2006 Lucas

* cited by examiner

*Primary Examiner* — Michael Trettel
(74) *Attorney, Agent, or Firm* — Baker & Daniels LLP

(57) ABSTRACT

An apparatus and method for aiding the insertion of a pillow into a pillowcase. The apparatus or device is flexible and lays flat in a neutral condition. After the pillow is placed onto the device, the device is wrapped around the pillow to compress the pillow, and edges of the device are engaged with one another to maintain the pillow in a compressed condition. The device and compressed pillow are slid into a pillowcase, or the pillowcase is slid over the device and compressed pillow, and the device is then slid outwardly from the pillowcase, allowing the pillow to expand and fill the pillowcase. Optionally, the edges of the device may first be disengaged to allow expansion of the pillow to fill the pillowcase prior to sliding the device outwardly from the pillowcase.

27 Claims, 6 Drawing Sheets

METHOD AND APPARATUS FOR INSERTING A PILLOW INTO A PILLOWCASE

CROSS REFERENCE TO RELATED APPLICATIONS

This application claims the benefit under Title 35, U.S.C. §119(e) of U.S. Provisional Patent Application Ser. No. 60/992,813, entitled METHOD AND APPARATUS FOR INSERTING A PILLOW INTO A PILLOWCASE, filed on Dec. 6, 2007, the disclosure of which is expressly incorporated by reference herein.

BACKGROUND

1. Field of the Invention

The present invention relates to a method and apparatus for inserting a pillow into a pillowcase.

2. Description of the Related Art

In the traditional method of inserting a pillow into a pillowcase, an individual will typically first hold an end of the pillow between their chin and chest, partially insert the other end of the pillow into the pillowcase and then shake the pillowcase and otherwise physically manipulate the pillow into the pillowcase. This causes the pillow to advance in a piecemeal fashion into the pillowcase. While this method is effective, it is cumbersome and time consuming, particularly for thick and long pillows such as those now typically used in hotels. Moreover, this method may be difficult for an individual with a disability or illness, such as arthritis, for example, and is particularly cumbersome in the occupational context, such as for hotel or hospital workers who replace pillowcases many times each day and could experience repetitive joint stress.

One known method for inserting a pillow into a pillowcase involves the use of a pillow insertion device formed as a resilient, relatively thin sheet of material that is bent into a generally U-shape prior to being inserted into the pillowcase. The device holds the pillowcase open and creates a three-dimensional cavity through which a pillow can be inserted. The device is made of a material such as plastic and is normally flat, such that, when the device is bent, the material is under stress. This material stress allows the pillowcase to be held open by the device when the device is bent into a U-shape and inserted into the pillowcase. However, the initial step of both bending the device into a U-shape and inserting the device into the pillowcase can be somewhat difficult, particularly for a single user, in view of the material stress whereby the device tends to revert to its flat shape. Then, when the pillow is inserted into the cavity formed by the device, the user must still shove, rearrange, and stuff the pillow inside the cavity and pillowcase, and it can be difficult to properly align the corners of the pillow with those of the pillowcase such that, after the final step of removing the device from the pillowcase, the pillow may be misaligned or improperly positioned within the pillowcase.

What is needed is a method and apparatus for inserting a pillow into a pillowcase that is an improvement over the foregoing.

SUMMARY

The present invention provides an apparatus and method for aiding the insertion of a pillow into a pillowcase. The apparatus or device is flexible and lays flat in a neutral condition. After the pillow is placed onto the device, the device is wrapped around the pillow to compress the pillow, and edges of the device are engaged with one another to maintain the pillow in a compressed condition. The device and compressed pillow are slid into a pillowcase, or the pillowcase is slid over the device and compressed pillow, and the device is then slid outwardly from the pillowcase, allowing the pillow to expand and fill the pillowcase. Optionally, the edges of the device may first be disengaged to allow expansion of the pillow to fill the pillowcase prior to sliding the device outwardly from the pillowcase.

In particular, in one embodiment, in order to compress the pillow for insertion into the pillowcase, the pillow is placed on the compression device in a substantially centered position. A user may grasp openings on opposing sides of the compression device to aid in wrapping the compression device around the pillow, so that the pillow is compressed and substantially encircled by the compression device. The user may then retain the pillow in its compressed state by engaging engagement structures on the opposing side portions or edges of the device. With the pillow compressed and the compression device retaining the pillow in its compressed state, the device and pillow may be easily slid into the pillowcase, or the pillowcase slid over the device and pillow.

Once received within the pillowcase, the user may optionally disengage the opposing engagement structures by grasping the openings in the compression device and shifting same towards one another, or by squeezing the sides of the compression device. Once the engagement structures are disengaged, the pillow expands within the pillowcase and pushes the opposing sides of the compression device away from one another. Then, by grasping the compression device with one hand and both the closed end of the pillowcase and the pillow with other hand, the user may then slide the compression device outwardly from the pillowcase with the pillow remaining in the pillowcase.

The present method and device is useful in the home, or in any environment in which pillowcases are changed frequently, such as in hotels or hospitals, for example. Advantageously, the present method and device reduces and/or eliminates repetitive stress imposed on the wrists and arms of users that would otherwise occur from traditional methods of inserting pillows into pillowcases.

In one form thereof, the present invention provides a method of inserting a pillow into a pillowcase, said method including the steps of: providing a pillow compression device having opposing side portions, each side portion having an engagement structure; positioning a pillow on the device; wrapping the device around the pillow to at least partially compress the pillow; engaging the engagement structures on the side portions of the device with one another to retain the pillow in its at least partially compressed state; inserting the device and pillow into a pillowcase; and removing the device from the pillowcase.

In another form thereof, the present invention provides a device for compressing a pillow for insertion into a pillowcase, said device including a flexible body having opposing side portions, each side portion having at least one aperture therein and an engagement structure, the engagement structures of the side portions engageable with one another upon wrapping the device into a substantially cylindrical cross-sectional shape.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION

Figure 1:
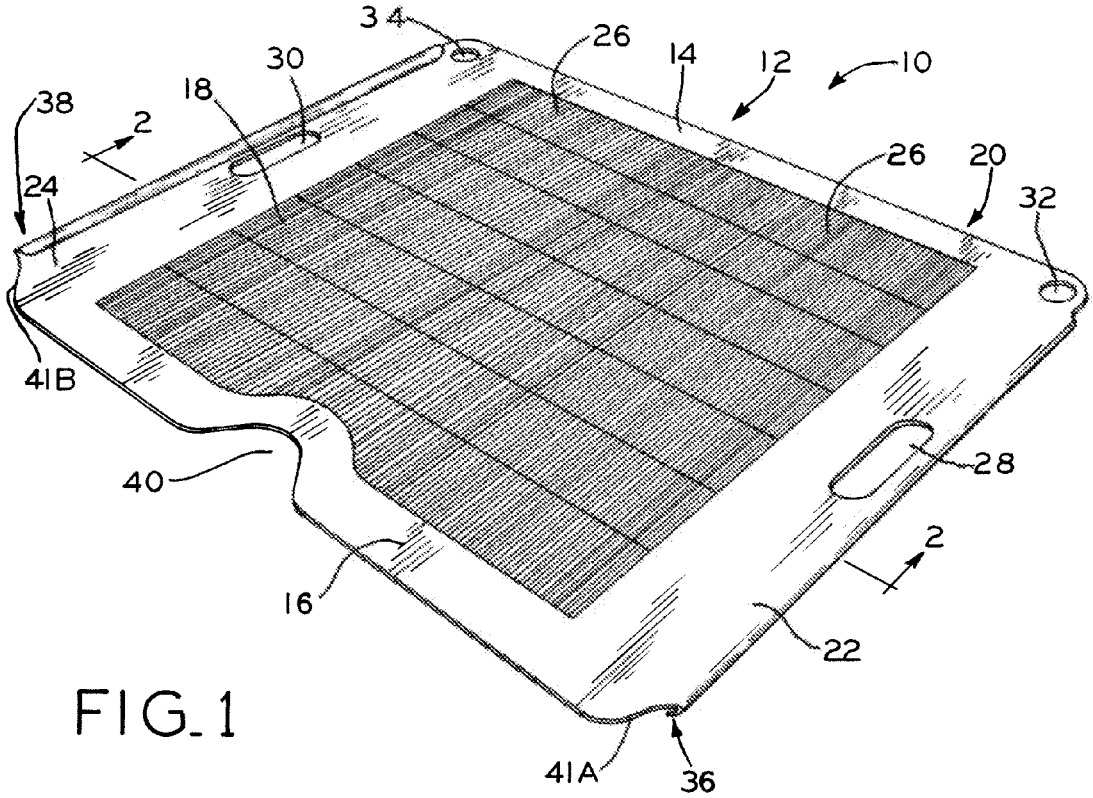
FIG. 1 is a perspective view of the compression device of the present invention.

The present invention provides a method and an apparatus or device 10 shown in FIG. 1, which may be referred to as a compression device, for inserting a pillow into a pillowcase. However, while described and depicted herein with specific reference to inserting a pillow into a pillowcase, the present device 10 may also be used for other types of similar operations. For example, device 10 may be utilized to compress blankets, clothes, towels, or any other material that can be compressed by wrapping device 10 around it, to aid in placing such items within any receptacle such as a bag, sack, duffle bag, or other storage container, for example. The specific description herein should not be taken to limit the scope of the present invention in any manner.

Referring to FIG. 1, compression device 10 is shown including body 12 having inner portion 18 and outer portion 20. Body 12 is generally flat or planar. In one exemplary embodiment, outer portion 20 substantially surrounds inner portion 18 and provides additional rigidity or reinforcement to device 10. Specifically, in this embodiment, outer portion 20 defines front portion 14, back portion 16, and opposing side portions 22, 24.

Figure 2:
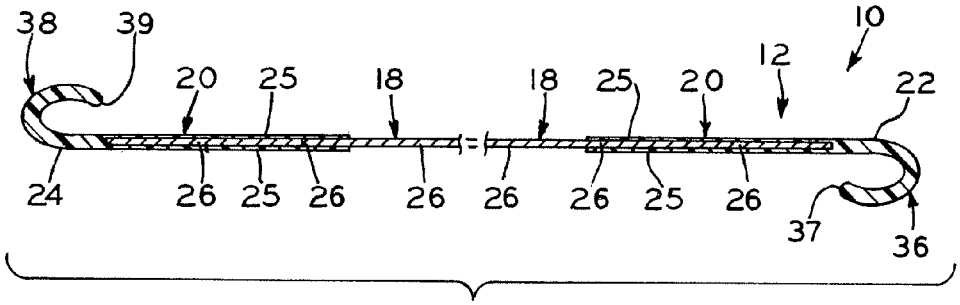
FIG. 2 is a cross-sectional view of the compression device of FIG. 1 taken along line 2-2 of FIG. 1.

Inner portion 18 and outer portion 20 are both formed from a substantially flexible material to allow body 12 to be bent or wrapped into a substantially elliptical or circular shape in cross-section, as shown in FIGS. 4-9. In one embodiment, inner portion 18 and outer portion 20 are formed from a plurality of slats 26 arranged parallel to one another between opposing side portions 22, 24 and extending longitudinally from front portion 14 to back portion 16 of body 12. Slats 26 may include small gaps therebetween which facilitate the release of air as the pillow is compressed, as described in detail below. In one embodiment, each of slats 26 is formed as an individual piece of wood, bamboo, cardboard or plastic material, for example. As shown in FIGS. 1 and 2, the portion of the plurality of slats 26 extending through outer portion 20 may be reinforced by placing tape and/or another strengthening material 25 over outer portion 20. In one embodiment, the outer portion 20 may be coated with a flexible plastic that provides sufficient reinforcement of outer portion 20, while allowing outer portion 20 to retain the flexibility necessary to operate as described in detail below.

In another embodiment, the entirety of inner portion 18 and outer portion 20 are formed from a substantially flexible plastic material, eliminating the need for the plurality of slats 26. In a further embodiment, the materials forming inner portion 18 and outer portion 20 are different, for example the outer portion may be formed from plastic as a substantially unitary structure and the inner portion may be formed of a plurality of slats 26 that are received by the outer portion.

Compression device 10 can be made from a number of suitable materials, such as bamboo, vinyl, plastic, cloth, canvas, and plastic, for example. Compression device 10 is constructed such that it has no material "memory", but rather is flexible and may be rolled up, folded, or laid flat when not in use. This allows compression device 10 to be wrapped around pillows or any other object that can be compressed. Also, compression device 10 may be formed with substantially smooth sides and corners to facilitate the easy removal of compression device 10 from a pillowcase, as described below.

As shown in FIG. 1, outer portion 20 includes elongate apertures or openings 28, 30 extending therethrough and formed in opposing side portions 22, 24 of body 12. Additionally, in one embodiment, outer portion 20 further includes openings 32, 34 extending therethrough and formed in front portion 14 adjacent to side portions 22, 24, i.e., in corners of the device. Openings 32, 34 are substantially smaller than openings 28, 30. Specifically, and as described in detail below, openings 28, 30 are sized for grasping by all of a user's fingers, while openings 32, 34 are sized for grasping by less than all of a user's fingers. While the sizes of openings 28, 30, 32, 34 are described and depicted herein with general reference to a user's fingers, it is noted that openings 28, 30, 32, 34 may be of any size that allows them to be grasped by a user.

Figure 4:
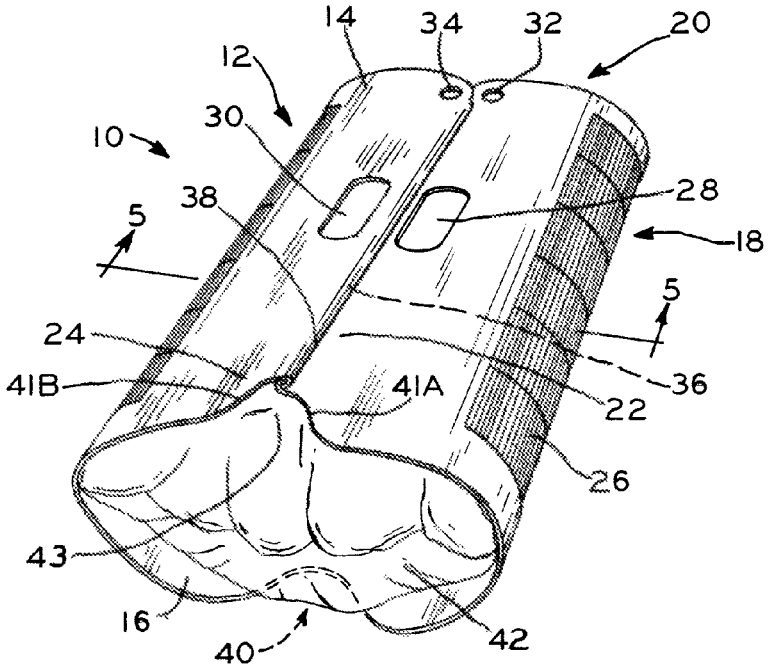
FIG. 4 is a perspective view of the compression device of FIG. 3 depicting the pillow in a compressed condition.

Positioned on opposing side portions 22, 24, respectively, of body 12 are engagement structures, such as J-hooks 36, 38. While described and depicted herein as J-hooks, the engagement structures of side portions 22, 24 may be any type of engagement structures capable of engaging each other in mating or joined relationship, such as hook and loop fasteners, magnets, snaps, latches and/or buckles, for example. As shown in FIG. 2, J-hooks 36, 38 are secured to and extend outwardly from side portions 22, 24 in opposing orientations. For example, J-hook 36 may be positioned in a substantially downward orientation and J-hook 38 may be positioned in a substantially upward orientation. J-hooks 36, 38 have projections 37, 39 that project inwardly toward inner portion 16 of body 12 and cooperate with side portions 22, 24 to form a substantially U-shaped cavity. Additionally, as shown in FIG. 1, body 12 of compression device 10 includes cutout 40 formed along back portion 16. Body 12 of compression device 10 further includes cutout portions 41*a*, 41*b* at its corners where back portion 16 joins opposing side portions 22, 24, respectively. Referring to FIG. 4, when J-hooks 36, 38 are engaged with one another and cutout portions 41*a* and 41*b* come together, a substantially mirror image of cutout 40 is formed in back portion 16 as cutout 43. Cutouts 40, 43 facilitate the removal of a pillowcase and pillow from compression device 10, as described in detail below.

Figure 12:
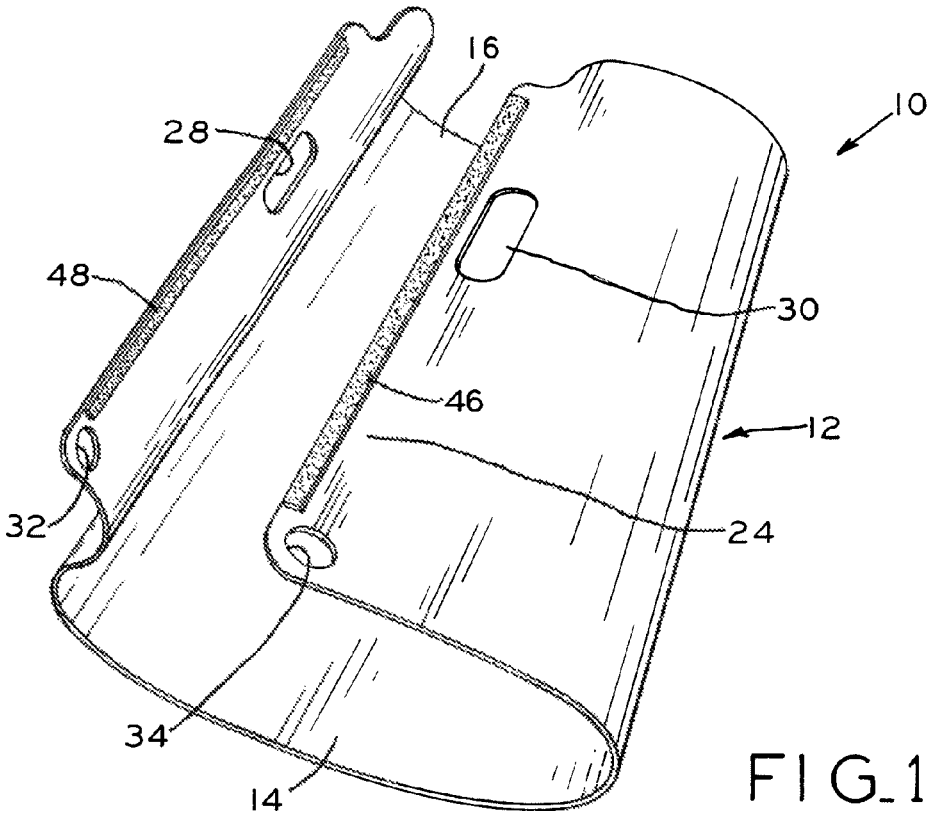
FIG. 12 is a perspective view of the compression device depicting alternative engagement structures in the form of hook and loop fasteners.

In another embodiment, shown in FIG. 12, engagement structures are provided as hook and loop fasteners 46, 48 positioned on opposing side portions 22, 24 of body 12, respectively. Hook and loop fasteners 46, 48 are secured to side portions 22, 24 in opposing orientations. For example, hook and loop fastener 46 may be positioned in a substantially upward orientation and hook and loop fastener 48 may be positioned in a substantially downward orientation. Hook and loop fasteners 46, 48 are used in the same manner as J-hooks 36, 38, as described above.

Figure 13:
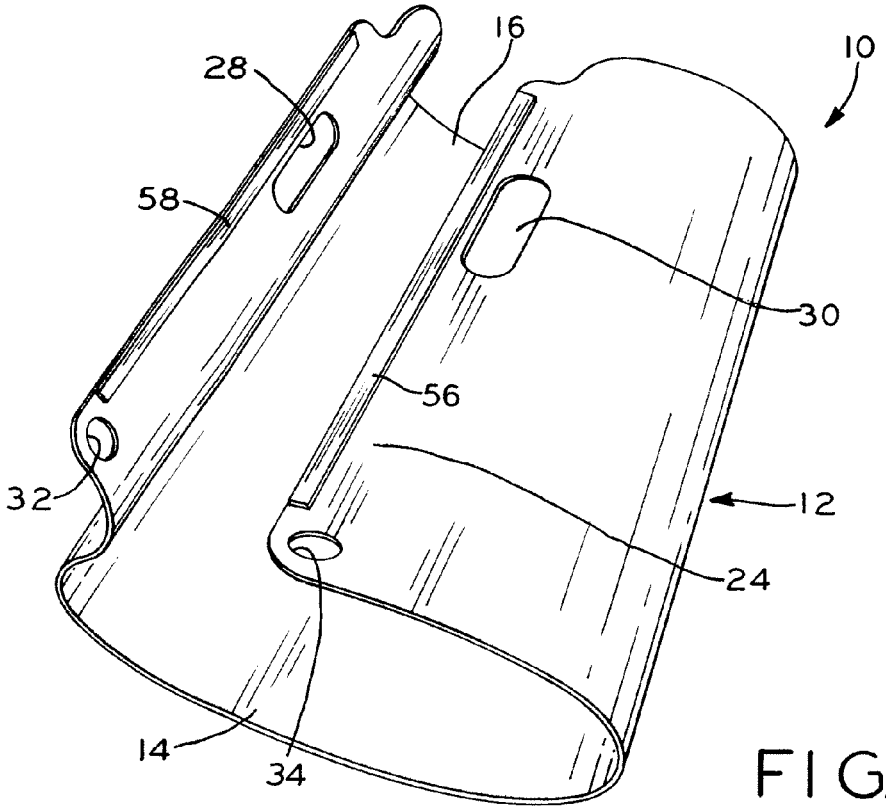
FIG. 13 is a perspective view of the compression device depicting alternative engagement structures in the form of magnets.

In a further embodiment, shown in FIG. 13, engagement structures are provided as magnets 56, 58 positioned on opposing side portions 22, 24 of body 12, respectively. Magnets 56, 58 are secured to side portions 22, 24 in opposing orientations. For example, magnet 56 may be positioned in a substantially upward orientation and magnet 58 may be positioned in a substantially downward orientation. Magnets 56, 58 are used in the same manner as J-hooks 36, 38, as described above.

Figure 3:
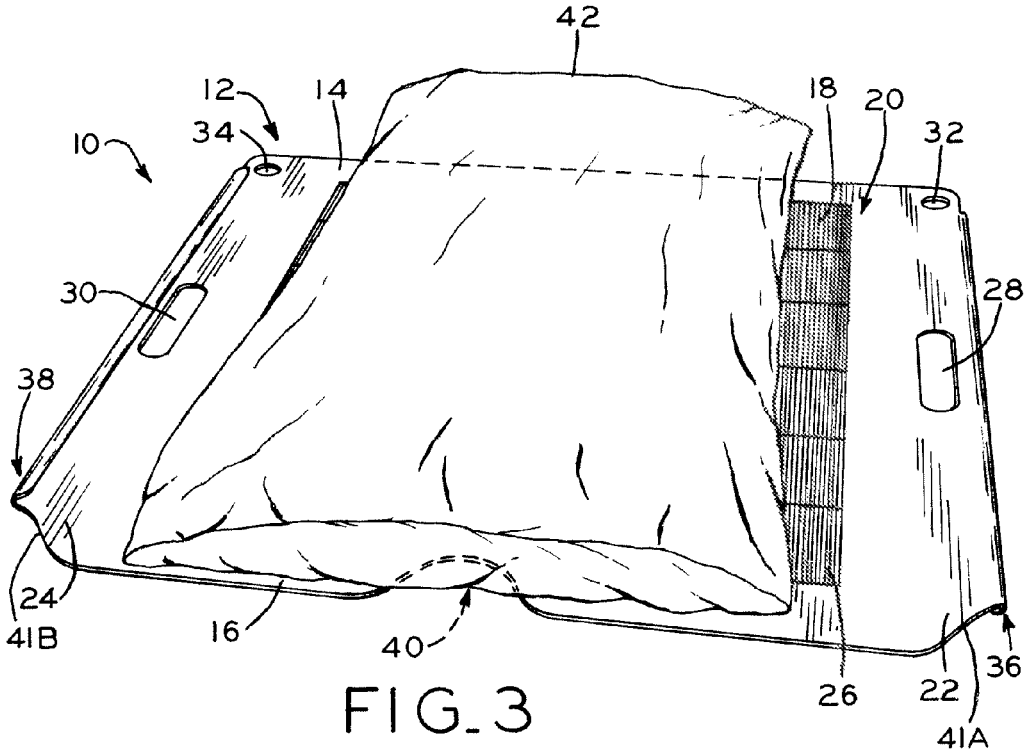
FIG. 3 is a perspective view of the compression device of FIG. 2 further depicting a pillow positioned thereon.

Referring to FIGS. 3-11, the operation of compression device 10 is shown. Specifically, referring to FIG. 3, pillow 42 is placed substantially centered on compression device 10 with the long dimension of pillow 42 parallel with side portions 22, 24 of device 10. An end of pillow 42 may be aligned with the edge of back portion 16 of device 10 and placed over cutout 40 as shown in FIGS. 3 and 4 to aid in removing device 10 from the pillowcase, as described below. With pillow 42 positioned as shown in FIG. 3, the user may grasp openings 28, 30 of compression device 10. The user then wraps side portions 22, 24 of body 12 of compression device 10 around pillow 42 and correspondingly brings side portions 22, 24 together. By wrapping side portions 22, 24 around pillow 42 and bringing side portions 22, 24 together, pillow 42 is at least partially compressed within compression device 10, causing the volume of pillow 42 to decrease. When compressed, the volume of pillow 42 may be reduced by as little as 5%, 10%, or 15%, or by as much as 20%, 30%, or 40%, for example.

Compression device 10 may be dimensioned to wrap around any size pillow, such as a standard size pillow with dimensions of about 20 inches by 26 inches, a queen size pillow with dimensions of about 20 inches by 30 inches, a king size pillow with dimensions of about 20 inches by 36 inches, a body pillow with dimensions of about 20 inches by 60 inches or about 20 inches by 72 inches, a continental pillow with dimensions of about 26 inches by 26 inches, a boudoir pillow with dimensions of about 12 inches by 16 inches, or any other size pillow.

Figure 5:
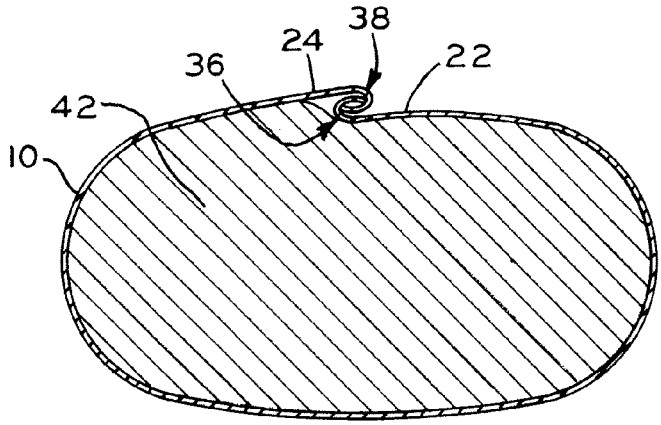
FIG. 5 is a cross-sectional view of the compression device of FIG. 4 taken along line 5-5 of FIG. 4.

The user then continues to advance side portions 22, 24 along one another until opposing projections 37, 39 of J-hooks 36, 38 have slid past one another. J-hooks 36, 38 may then be engaged with one another in mating relationship to retain compression device 10 in the position shown in FIG. 4 with pillow 42 in a compressed condition. Specifically, as shown in FIGS. 4 and 5, J-hooks 36, 38 are engaged by substantially simultaneously inserting projection 37 into the U-shaped cavity formed by J-hook 38 and side portion 24 and inserting projection 39 into the U-shaped cavity formed by J-hook 36 and side portion 22. Once in this position, the individual may release any pressure still being exerted on compression device 10. The compressed pillow 42 will provide an outward pressure on compression device 10 that maintains J-hooks 36, 38 in mating relationship.

Figure 6:
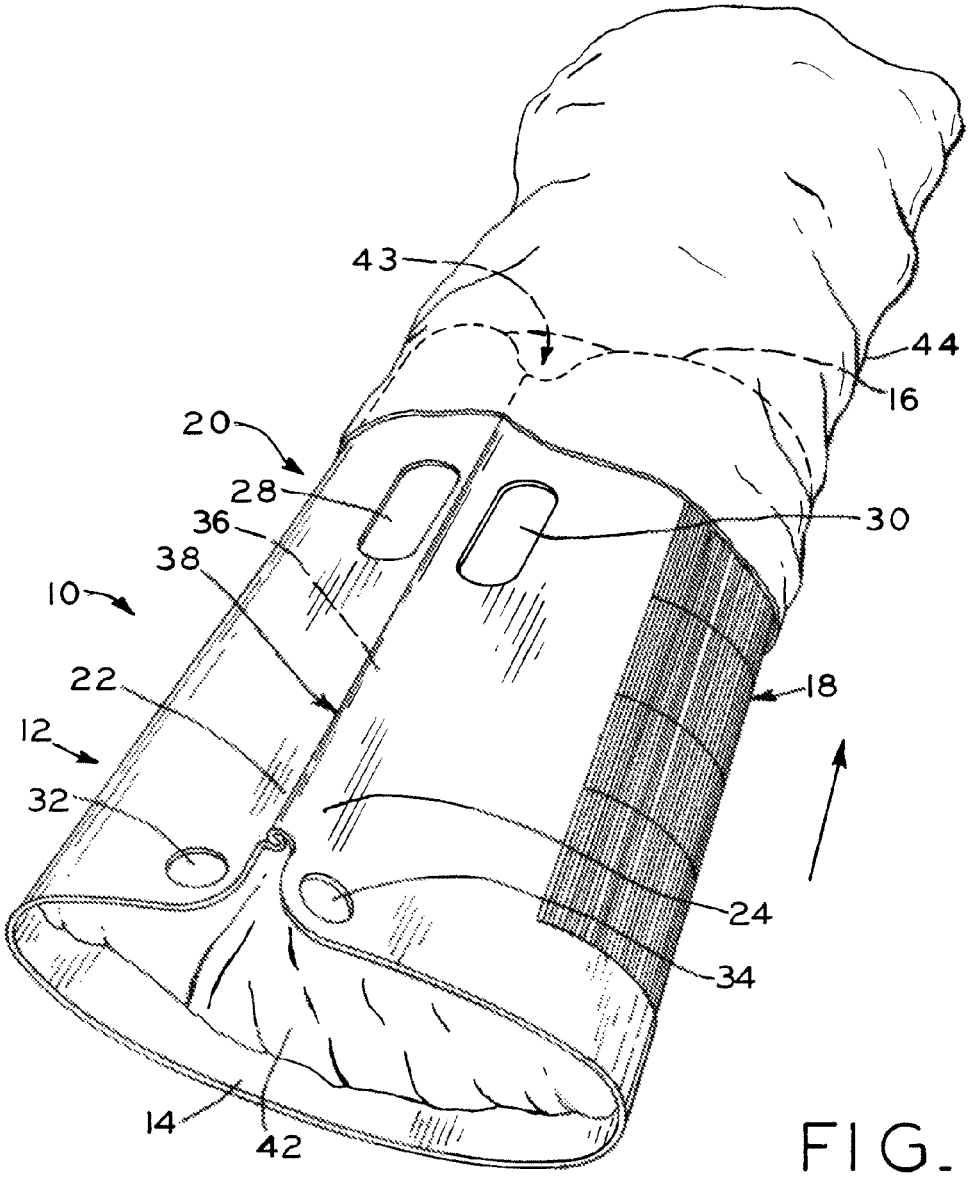
FIG. 6 is a perspective view of the compression device and pillow of FIG. 4 further depicting the compression device partially positioned within a pillowcase.
Figure 7:
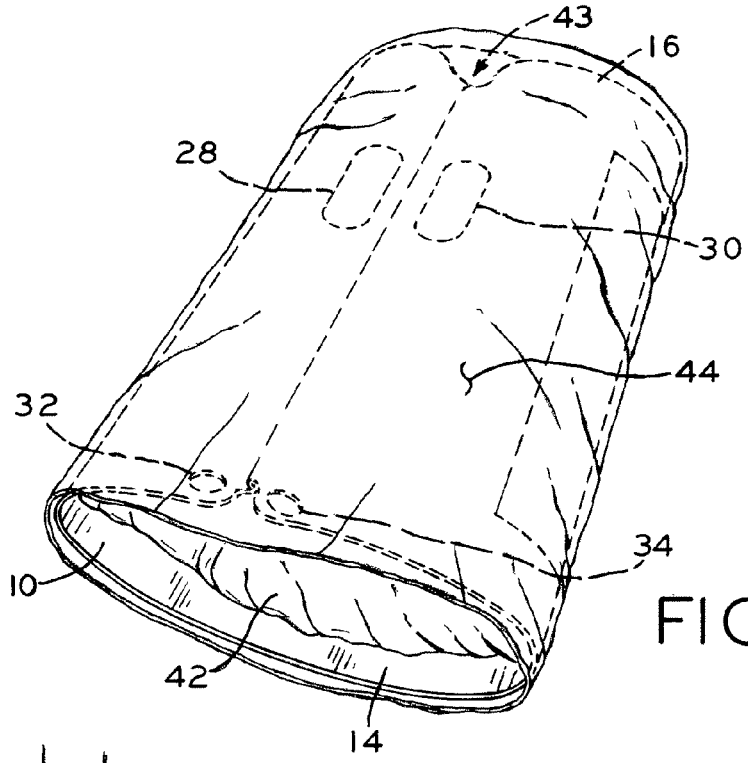
FIG. 7 is a perspective view of the compression device and pillow of FIG. 4 further depicting the compression device substantially entirely positioned within a pillowcase.

Once in the position shown in FIG. 4, front portion 14 of compression device 10 and pillow 42 may be inserted into pillowcase 44, as shown in FIGS. 6 and 7. Due to the retention of pillow 42 in the compressed state, compression device 10 and pillow 42 can be easily slid into pillowcase 44, or pillowcase 44 slid onto compression device 10 and pillow 42, eliminating the need to vigorously shake pillow 42 or otherwise shove pillow into pillowcase 44. Referring to FIG. 7, once compression device 10 and pillow 42 are received within pillowcase 44, pillowcase 44 may be manually adjusted as needed to align pillow 42 and pillowcase 44, though this will typically not be needed so long as pillow 42 is initially centered on device 10 as shown in FIG. 3 and described above. Then, as described below, compression device 10 is removed from pillowcase 44 without also removing pillow 42.

Before removing compression device 10 from pillowcase 44 in the manner described below, the user may optionally disengage J-hooks 36, 38 from one another to allow pillow 42 to begin expanding within pillowcase 44 and to aid in removal of device 10 from pillowcase 44.

Figure 9:
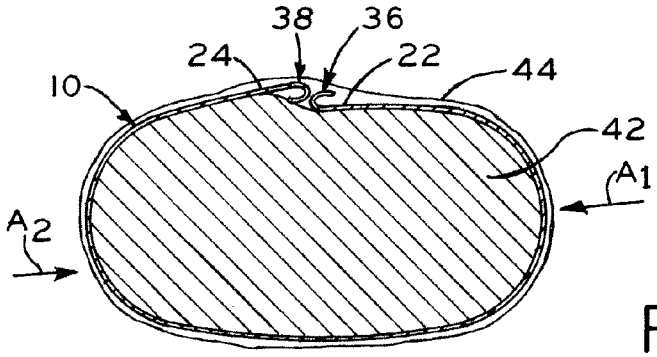
FIG. 9 is a cross-sectional view of the compression device, pillow, and pillowcase of FIG. 8 taken along line 9-9 of FIG. 8.

In particular, as shown in FIG. 9, the user may squeeze the opposite sides of body 12 toward one another in the directions of arrows $A_1$ and $A_2$, causing sides 22, 24 to advance further past one another and correspondingly causing J-hooks 36, 38 to disengage from one another under the expansion force of pillow 42. Alternatively, the user may grasp sides 22 and 24 through openings 32 and 34 and shift sides 22 and 24 with respect to one another, causing J-hooks 36, 3 8 to disengage from one another under the expansion force of pillow 42. Once J-hooks 36, 38 are disengaged from one another, pillow 42 begins to expand to its original size within pillowcase 44.

Figure 8:
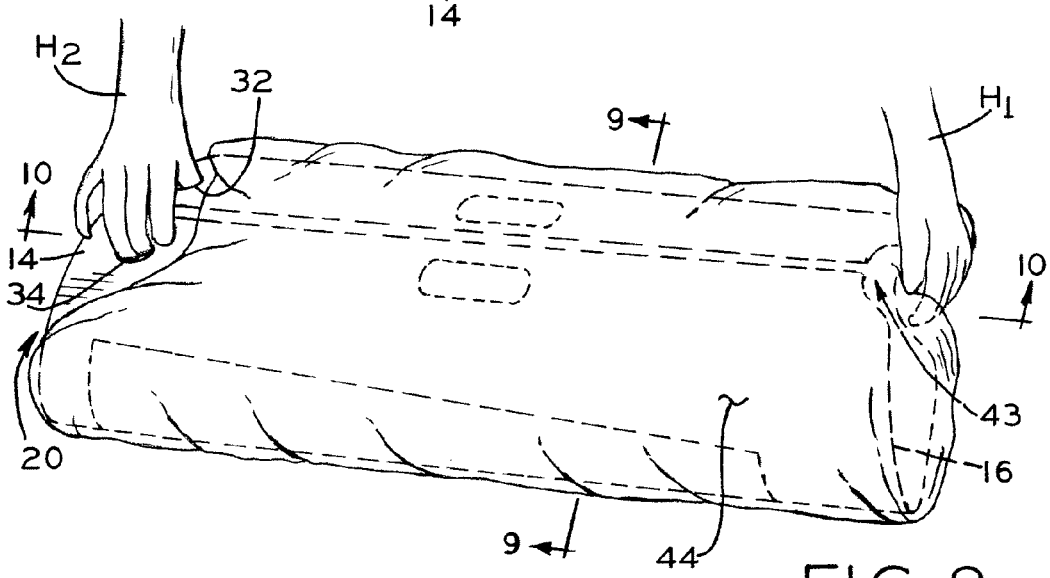
FIG. 8 is a perspective view of the compression device, pillow, and pillowcase of FIG. 7 further depicting an individual grasping the compression device, pillow, and pillowcase.
Figure 10:
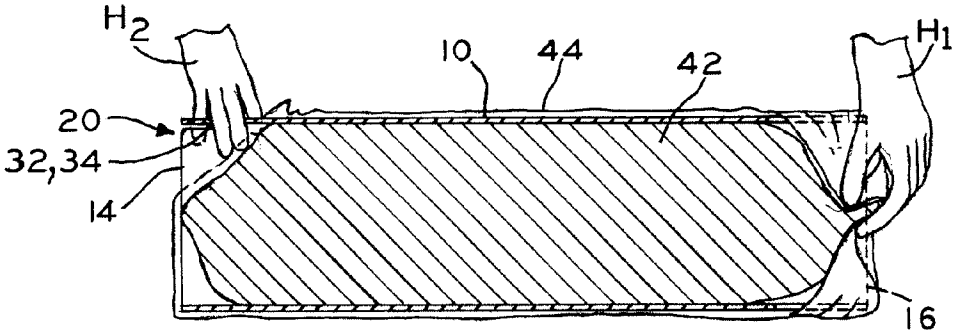
FIG. 10 is a cross-sectional view of the compression device, pillow, and pillowcase of FIG. 8 taken along line 10-10 of FIG. 8.

Regardless of whether the user first disengages J-hooks 36, 38 from one another, the user removes device 10 from pillowcase 44 in the following manner. Referring to FIGS. 8 and 10, the user grasps pillowcase 44 and pillow 42 together with a first hand $H_1$ at the closed end of pillowcase 44 within the clearance provided by cutouts 40 and 43, and also grasps openings 32, 34, respectively, with a second hand $H_2$.

Figure 11:
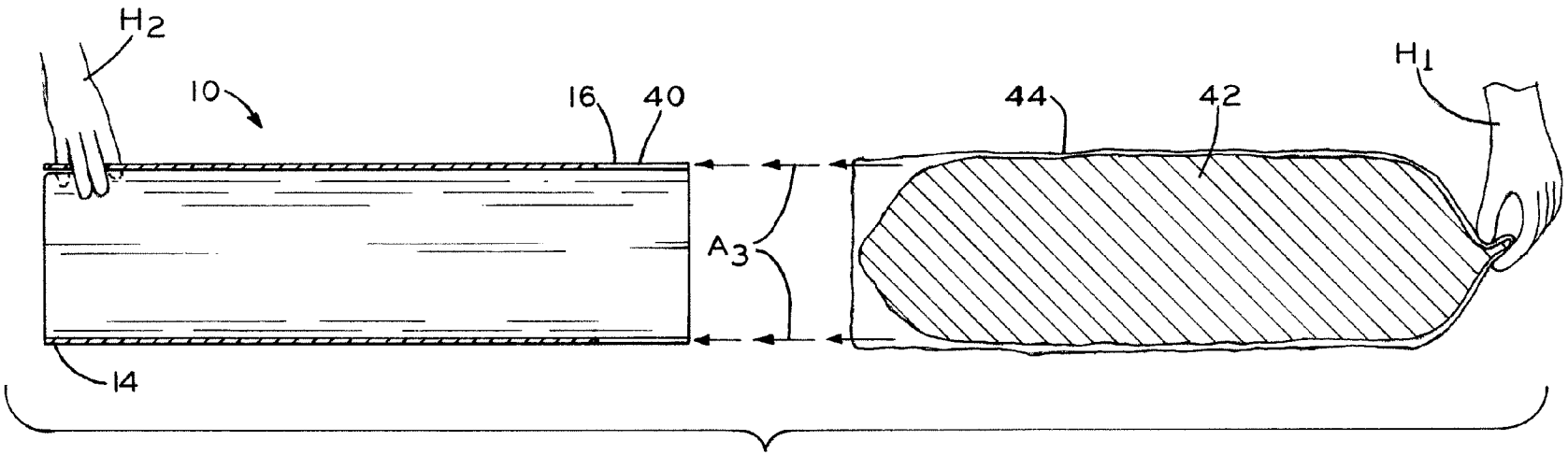
FIG. 11 is a cross-sectional view of the compression device, pillow, and pillowcase of FIG. 10 taken along line 10-10 of FIG. 8 and further depicting the compression device separated from the pillow and pillowcase.

Then, referring to FIGS. 10 and 11, the user either pulls first hand $H_1$ away from second hand $H_2$, or pulls second hand $H_2$ away from first hand $H_1$. Either way, as shown in FIG. 11, device 10 is slid outwardly of pillowcase 44 along direction $A_3$. The user may then release pillow 42 and pillowcase 44 with first hand $H_1$, and pillow 42 may expand to its original shape within pillowcase 44.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of inserting a pillow into a pillowcase, said method comprising the steps of providing a pillow compression device having opposing side portions, each side portion having an engagement structure;

positioning a pillow on the device;

wrapping the device around the pillow to at least partially compress the pillow;

engaging the engagement structures on the side portions of the device with one another to retain the pillow in its at least partially compressed state;

inserting the device and pillow into a pillowcase; and removing the device from the pillowcase.

2. The method of claim 1, further comprising, subsequent to said inserting step and prior to said removing step, the additional step of disengaging the engagement structures to allow the pillow to expand to a substantially uncompressed state.

3. The method of claim 2, wherein said disengaging step comprises grasping openings in the device and shifting the side portions of the device.

4. The method of claim 2, wherein said disengaging step comprises pushing the side portions of the device toward one another.

5. The method of claim 1, wherein said removing step further comprises at least one of:

pulling the device outwardly from the pillowcase while grasping the pillowcase and pillow together; and pulling the pillowcase and pillow away from the device while grasping the pillowcase and pillow together.

6. The method of claim 1, wherein said wrapping step further comprises grasping the device through openings in the side portions of the device.

7. The method of claim 1, wherein said engaging step further comprises engaging J-hooks on the side portions of the device.

8. The method of claim 1, wherein said engaging step further comprises engaging hook and loop fasteners on the side portions of the device.

9. The method of claim 1, wherein said engaging step further comprises engaging magnets on the side portions of the device.

10. The method of claim 1, wherein the pillow compression device includes a flexible body formed of a material having no material memory.

11. A device for compressing a pillow for insertion into a pillowcase, said device comprising:

a flexible body having opposing side portions, each said side portion having at least one aperture therein and an engagement structure, said engagement structures of said side portions engageable with one another upon wrapping said device into a substantially cylindrical cross-sectional shape, said body further including a plurality of gaps, disposed in at least a central portion of said body. for allowing passage of air through said gaps.

12. The device of claim 11, wherein said flexible body is at least partially formed by a plurality of slats arranged substantially parallel to each other and to said side portions, said slats spaced from one another to define said plurality of gaps between said slats.

13. The device of claim 11, wherein said apertures are elongate in shape.

14. The device of claim 11, further comprising at least four corner portions, and a pair of second apertures respectively formed at two of said corner portions.

15. The device of claim 11, wherein said flexible body is formed of a material having no material memory.

16. The device of claim 11, wherein said engagement structures comprise J-hooks.

17. The device of claim 11, wherein said engagement structures comprise hook and loop fasteners.

18. The device of claim 11, wherein said engagement structures comprise magnets.

19. A device for compressing a pillow for insertion into a pillowcase, said device comprising:

a flexible body having opposing side portions, each said side portion having at least one aperture therein and an engagement structure, said engagement structures of said side portions engageable with one another upon wrapping said device into a substantially cylindrical cross-sectional shape, wherein said engagement structures comprise J-hooks.

20. A device for compressing a pillow for insertion into a pillowcase, said device comprising:

a flexible body having opposing side portions, each said side portion having at least one aperture therein and an engagement structure, said engagement structures of said side portions engageable with one another upon wrapping said device into a substantially cylindrical cross-sectional shape, wherein said engagement structures comprise hook and loop fasteners.

21. A device for compressing a pillow for insertion into a pillowcase, said device comprising:

a flexible body having opposing side portions, each said side portion having at least one aperture therein and an engagement structure, said engagement structures of said side portions engageable with one another upon wrapping said device into a substantially cylindrical cross-sectional shape, wherein said engagement structures comprise magnets.

22. A device for compressing a pillow for insertion into a pillowcase, said device comprising:

a flexible body formed of a material having no material memory and including opposing side portions, each said side portion having an engagement structure, said engagement structures of said side portions engageable with one another upon wrapping said device into a substantially cylindrical cross-sectional shape.

23. The device of claim 22, wherein said body includes a plurality of gaps therein adapted for passage of air through said gaps.

24. The device of claim 22, wherein said engagement structures comprise J-hooks.

25. The device of claim 22, wherein said engagement structures comprise hook and loop fasteners.

26. The device of claim 22, wherein said engagement structures comprise magnets.

27. The device of claim 22, wherein said side portions each include at least one aperture.

* * * * *

UNITED STATES PATENT AND TRADEMARK OFFICE

CERTIFICATE OF CORRECTION

PATENT NO. : 7,958,580 B2
APPLICATION NO. : 12/274632
DATED : June 14, 2011
INVENTOR(S) : Nancy A. Zorger It is certified that error appears in the above-identified patent and that said Letters Patent is hereby corrected as shown below:

In Claim 1, Column 6, Line 67, add a : after the words "steps of"

Signed and Sealed this
Ninth Day of August, 2011

David J. Kappos

David J. Kappos
*Director of the United States Patent and Trademark Office*